428-408
C6306 OR 4,339,328

[redacted]

United States Patent [19]
Stadelhofer et al.

[11] 4,339,328
[45] Jul. 13, 1982

[54] PROCESS FOR THE PRODUCTION OF HIGH GRADE CARBONACEOUS BINDERS

[75] Inventors: Jürgen Stadelhofer, Dortmund; Heinz-Gerhard Franck, Bad Soden-Neuenhain; Helmut Köhler, Mulheim an der Ruhr; Heinrich Louis, Duisburg, all of Fed. Rep. of Germany

[73] Assignee: Rütgerswerke Aktiengesellschaft, Frankfurt am Main, Fed. Rep. of Germany

[21] Appl. No.: 291,889

[22] Filed: Aug. 11, 1981

[30] Foreign Application Priority Data

Sep. 3, 1980 [DE] Fed. Rep. of Germany ..... 3033075

[51] Int. Cl.[3] ..... C10G 1/00; H01B 1/04; C10C 0/00

[52] U.S. Cl. ..... 208/8 LE; 208/23; 252/502; 373/88; 204/294

[58] Field of Search ..... 208/8 LE, 23; 252/502; 13/18 R, 18 B; 204/294

[56] References Cited

U.S. PATENT DOCUMENTS

| | | | |
|---|---|---|---|
| 3,849,287 | 11/1974 | Gleim et al. | 208/8 LE |
| 3,966,585 | 6/1976 | Gray et al. | 208/8 LE |
| 4,040,941 | 8/1977 | Yamada et al. | 208/8 LE |
| 4,072,599 | 2/1978 | Bullough et al. | 204/294 |
| 4,188,235 | 2/1980 | Espenscheid et al. | 252/502 X |

FOREIGN PATENT DOCUMENTS

| | | | |
|---|---|---|---|
| 1105379 | 4/1961 | Fed. Rep. of Germany | 252/502 |

*Primary Examiner*—Delbert E. Gantz
*Assistant Examiner*—William G. Wright
*Attorney, Agent, or Firm*—Beveridge, DeGrandi & Kline

[57] ABSTRACT

A process is described for the production of high grade carbonaceous binders, wherein an aromatic high grade carbonaceous material is produced from 5–40% by weight of reduced or low ash coal or similar carbon containing raw materials by treatment with 20–80% by weight of high-boiling aromatic solvents, derived from coal, and 15–50% by weight of high-boiling aromatic solvents, derived from mineral oil, at temperatures of 300°–420° C. and for a reaction period of 1–4 hours, at a reaction pressure of up to 50 bar, and is optionally freed from low-boiling components.

6 Claims, No Drawings

X3005H
X2027T

PROCESS FOR THE PRODUCTION OF HIGH GRADE CARBONACEOUS BINDERS

The invention relates to a novel process for the production of high grade carbonaceous binders by treatment of reduced or low ash coal or similar carbon-containing raw materials at elevated temperature and elevated pressure, using aromatic solvents derived from coal and mineral oil.

In the production of a great number of metals, electrothermal refining processes are employed in the technology, in which carbon electrodes find application. Examples of refining processes of this kind are the production of electric steel and the Hall/Heroult-process for the production of technically pure aluminium. Carbon is required in large quantities for the latter process, since up to 0.5 tons of technical carbon is consumed for the production of 1 ton of aluminium, (G. Collin, W. Gemmeke, Erdöl und Kohle (Petroleum and Coal), 30, 25, 1977).

The electrodes, employed in that case, consist of a carbon lattice, which is usually produced from coke through the delayed coking of mineral oil residues or from pitch coke by the coking of coal tar pitch, and a suitable binder.

Thermally re-conditioned coal tar pitch has hitherto been mainly used as binder, due to its excellent binder properties.

Binders, based on mineral oil derivatives, have hitherto not attained the superior properties of coal tar pitch and therefore have found only limited application in industrial practice.

Although the qualitative evaluation of electrode binders is largely empirical, (see, for example, B. E. A. Thomas, Gas World, p 51, 1960; C. R. Mason, Fuel, 49, 165, 1970), there are certain fundamental conditions regarding the suitability of a binder.

In this connection, a usable electrode binder must fulfill the following quality criteria:

| | |
|---|---|
| coking residue (according to Conradson) | >50% |
| ash content | 0.3% max. |
| quinoline-insoluble content | >7% |
| toluene-insoluble content | >25% |
| softening point (K.S.) | >80° C.–120° C. |

Furthermore, a low sulphur content, (<1%), a low metal content as well as suitable boiling behaviour, (initial boiling point >270° C.), are desirable.

In order to avoid the exclusive dependence on binders, derived from coal tar, in the production of electrodes, attempts have not been lacking to employ residues, having an increased proportion of mineral oil derivatives, as raw materials for binders.

Owing to the differing chemical nature of the residues from mineral oil chemistry, by comparison with high-aromatic coal tar pitch, however, the solution of this problem is extremely difficult.

As has been explained above, the most important property for a good electrode binder is a high coking residue. Owing to the predominantly aliphatic nature of residues derived from mineral oil, elaborate thermal or chemical aromatic conversion is necessary for obtaining high coking residues. Thus, for example, U.S. Pat. No. 4,039,423 describes a process according to which a decantation oil from catalytic cracking is heated under pressure to temperatures >413° C., the heat-treated pitch is separated from low-boiling components, for obtaining a softening point of 65°–121° C., and the pitch, thus obtained is further thermally re-conditioned by blowing through with air or oxygen.

West German Offenlegungsschrift No. 22 32 268 describes a process, according to which residues from the vapour cracking of mineral oil fractions are refined to binders. The disadvantage of this process is that oxidative polymerisation and drastic condensation with Lewis acids, particularly aluminium chloride or iron chloride, is necessary for obtaining the high-aromatic properties required.

Apart from the thermal process steps that have to be undertaken, these processes have the disadvantage that the yield of binder, (related to the oil employed) is <60% and thus large proportions of coupling products arise. Besides, despite the elaborate aromatic conversion, the obtainable coking residues only appear at the lower limit of the desirable grades.

Another attempt at producing electrode binders on a basis, independent of coal tar pitch, is reported on by V. L. Bullough et al., (Light Metals, p. 483, 1980; C. J. McMinn. Ed; The Metallurgical Society of AIME, Warrendale, Pa., 1979).

According to this process, a pitch-like product, obtained by solvent-refining of coal, using molecular hydrogen at relatively high pressures, (SRC pitch) is fluxed with anthracene oil for adjusting the desired softening point.

Owing to the relatively low coking residue of the electrode binder, produced in this way, the quality of this coal-derived binder is still capable of further improvement. Besides, since anthracene oil preferentially serves for the production of important chemical raw materials for the dyestuff industry, it is available for these purposes only to a limited extent. Moreover, elaborate filtration or some other thermo-mechanical separation of the ash components are required in a process step, preceding the production of the electrode binder, for the production of the SRC pitch. This process step presents the actual problem step in coal liquefaction and, despite numerous efforts, is still far removed from technological perfection.

It was therefore an object of the present invention to develop a simple process for the production of high grade carbonaceous binders and to produce electrode binders, having the known good properties of coal tar pitch, on a raw material basis, largely independent of coal tar pitch.

According to the invention, this problem is solved by a process for the production of high grade carbonaceous binders in that an aromatic high grade carbonaceous material is produced from 5–40% by weight of low ash coal or similar carbon-containing raw materials by treatment with 20–80% by weight of high-boiling aromatic solvents, derived from coal, and 15–50% by weight of high-boiling aromatic solvents, derived from mineral oil, at temperatures of 300°–420° C., for a reaction period of 1–4 hours, at a reaction pressure of up to 50 bar, and is optionally freed from low-boiling components.

By disintegration of reduced ash coal or similar carbon-containing materials with a combination of converted aromatic residues from mineral oil processing or petrochemistry and high-boiling aromatic oils from the refining of coal tar, a low ash content, homogeneous high grade carbonaceous material is produced, which is suitable as an impregnating agent, e.g. for graphite electrodes, and the physico-chemical properties thereof can be adjusted, if desired, by high-aromatic additives, such as coal tar hard pitch or hard pitch from the processing of pyrolysis oils, for use as electrode binder.

The high grade carbonaceous material thus obtained is optionally freed by distillation, up to 5% by weight, from low boiling components and homogeneously mixed with 0–60% by weight of hard pitch for the production of the electrode binders. The materials used as principal raw materials for the production of electrode binders by the process according to the invention are those that hitherto could not be utilised for reasons of quality for the production of high grade electrode binders. According to the invention, these are coal and, for the disintegration of the latter, residues from the vapour cracking of naphtha or gas oil, residues from cat crackers, residues from the delayed coking as well as high-boiling aromatic distillates from the refining of coal tar, having an average boiling point >350° C. For the final adjustment of the flow properties, of the coking residue and further important quality criteria, up to 60%, (related to high grade carbonaceous material, produced by disintegration of coal), of distillation residues from the processing of coal tar pitch or, preferably, from the distillative processing or pyrolysis oil, having a softening point of 40°–160° C. (K.S.), are employed according to the invention.

The choice of the grade of coal is of minor importance in the process according to the invention. Preference is given, however, to coals having a high carbon content; the nature of the ash should be such that separation is possible according to known processes (e.g. U.S. Pat. No. 4,134,737) the entire disclosure of which is relied on and incorporated herein by reference.

Ash reduction processes of this kind, however, are not a subject of the Patent Application. In order to ensure the wide scope of application of the present process, an ash reduction process was chosen, according to which the ash content of the coal is reduced by particularly intensive chemical treatment with acids and bases.

Other ash reduction processes, which provide for ash reduction under similar conditions, should therefore be similarly suitable for the production of low ash content coals for the process according to the invention.

When extra-high purity coals, having an ash content of <1%, are used, ash separation may even become superfluous.

The ash reduction processes for coal generally provide for drastic chemical reactions, using acids, bases and oxidising agents, which have an influence on the dissolution of the coal; particularly in the case of oxidative treatment of coal, significant deterioration of the solubility in aromatic solvents is generally assumed, (C. Kröger, Erdöl und Kohle (Petroleum and Coal), 9, 1956, 441).

Surprisingly, however, it has been shown that, despite the drastic conditions, utilized in the ash reduction, and the chemical modification of the coal, which it involves, good homogenisation with the solvent mixture can be obtained and high grade electrode binders can thus be produced.

Low ash content is desirable in the choice of the solvent components employed for the disintegration of the coal; this condition is particularly fulfilled in the case of pyrolysis oils obtained from the vapour cracking of mineral oil fractions, in the case of distillates from coal tar refining and in the case of residual oils from delayed coking and similarly, in the case of selected coal tar pitches. However, residues from catalytic cracking are equally suitable as complementary solvents, if the ash content is low.

In the process according to the invention, however, pyrolysis oils from the vapour cracking of mineral oil fractions are preferably used, since these oils have a marked tendency to polymerize under the extremes of the reaction conditions which may be used in the process according to the invention, which is advantageous for attaining a high coking residue.

The coal tar oils, preferably used, are distillates from the heat/pressure treatment of coal tar pitch, having an average boiling point >350° C. or comparable distillates from the distillative processing of coal tar.

Thus a simple process for the production of high quality electrode binders becomes available, in which especially the widely available raw materials, coal and residues, derived from mineral oil, can find application as main components.

The production of the binders according to the invention is described in Examples 1 to 3.

A conventional electrode binder, having the known good properties and produced on the basis of coal tar pitch, (Comparative Example 4), serves for comparison.

In this connection, QI denoted quinoline-insoluble matter and TI denoted toluene-insoluble matter. The softening points were determined according to the Krämer-Sarnow method. All quantitative data refer to parts by weight; similarly, all percentage data denote percent by weight.

EXAMPLE 1

The production of reduced ash coal was effected following U.S. Pat. No. 4,134,737. According to the latter, 1 part by weight of finely divided Westerhold open-burning coal, (ash content: 7.8%; volatile content of material, free from water and ash: 38%) is treated for 3 hours with 4 parts by weight of 10% caustic soda solution at 250° C.

The washed reaction product is further treated with two parts by weight of dilute sulphuric acid (5%) at 80° C. and for a reaction time of 30 minutes.

The final treatment is carried out with 1.5 parts by weight of 18% nitric acid at 75° C. and for a reaction period of 1 hour.

The ash content of the coal, treated according to these 3 different process steps, is 0.9%. The yield is quantitative.

For the production of electrode binders, a reaction mixture consisting of 30 parts by weight of reduced ash Westerhold coal,
30 parts by weight of pyrolysis residue from the vapour cracking of naphtha, (initial boiling point: 220° C., 50% at 360° C.) and
40 parts by weight of pitch distillate from the heat/pressure treatment of coal tar pitch (initial boiling point: 305° C., 50% at 416° C., 80% at 455° C.), is homogenised, with thorough mixing, at 375° C. and for a reaction time of 2 hours. The maximum reaction pressure is 24 bar. After separation of 3% of low-boiling components, a pitch-like high-grade carbonaceous material is obtained in 95% yield, which is homogeneously mixed with 30% of hard pitch from the processing of coal tar pitch/normal pitch, (for production see U.S. Pat. No. 2,985,577). The softening point of this hard pitch is 160° C. (K.S.). The binder, produced in this way, is characterised by the data given in the table.

EXAMPLE 2

30 parts by weight of reduced ash Westerhold open-burning coal are treated with 20 parts by weight of pitch distillate from the heat/-pressure treatment of coal tar pitch, 40 parts by weight of pyrolysis residue from the cracking of naphtha, as described in Example 1 and 10 parts by weight of cat cracker residues at 400° C. for a reaction time of 3 hours. The maximum reaction pressure is 40 bar.

The reaction product, obtained in 95% yield after separation of 3% of low-boiling components, is a high-grade carbonaceous material, having a softening point of 60° C. (K.S.). This high-grade carbonaceous material is homogeneously mixed with 50 parts by weight of hard pitch, derived by distillation from pyrolysis residues, which arise in the cracking of naphtha. The softening point of this hard pitch is 135° C. (K.S.).

The binder, produced in this way, is characterised by the data, given in the table.

EXAMPLE 3

The procedure is as in Example 1.

The coal used is a gas coal, having a volatile content of 26.5 and an ash content of 1.9%. Ash reduction is effected as described in Example 1; the residual ash content of the coal is 0.8%.

30 parts by weight of reduced open-burning coal are reacted with 40 parts by weight of pitch distillate from the heat/-pressure treatment of coal tar pitch and 30 parts by weight of pyrolysis oil from the vapour cracking of naphtha, with thorough mixing, at 400° C. and for a reaction time of 2 hours.

The maximum reaction pressure is 18 bar.

A pitch-like high grade carbonaceous material, having a softening point of 80° C. (K.S.), is obtained in 97% yield.

This high grade carbonaceous material is separated from low-boiling components (3%) and homogeneously mixed with 30% a hard pitch, having a softening point of 135° C. (K.S.) and originating from the distillative processing of pyrolysis oil.

The binder, produced in this way, is characterised by the data given in the table.

EXAMPLE 4: (Comparative example)

For comparison's sake, a conventional electrode binder based on coal tar pitch, is listed in the table.

| Characteristics of the Electrode Binders | | | | | |
|---|---|---|---|---|---|
| | Product Porperties | | | | |
| Raw Material Components | Coking Residue (According to Conradson) | Softening Point (K.S.) °C. | Ash Content % | QI % | TI % |
| Example 1: | | | | | |
| High grade carbonaceous material consisting of 30 parts by weight Westerholt coal, 30 parts by weight pyrolysis residue, 40 parts by weight pitch distillate, and 30 parts by weight hard pitch | 51 | 90 | 0.28 | 13 | 38 |
| Example 2: | | | | | |
| High grade carbonaceous material consisting of 30 parts by weight Westerholt coal, 20 parts by weight pitch distillate, 40 parts by weight pyrolysis residue, 10 parts by weight cat cracker, and 50 parts by weight hard pitch | 54 | 93 | 0.29 | 10 | 32 |
| Example 3: | | | | | |
| High grade carbonaceous material consisting of 30 parts by weight gas coal, 40 parts by weight pitch distillate, 30 parts by weight pyrolysis oil, and 30 parts by weight hard pitch | 54 | 92 | 0.26 | 14.5 | 35 |
| Example 4: | | | | | |
| (Comparative Example) Conventional electrode binder material from coal tar pitch | 54 | 90 | 0.27 | 13 | 35 |

Explanation:
QI = quinoline-insoluble
TI = toluene-insoluble

We claim:

1. A process for the production of high grade carbonaceous binders, comprising producing an aromatic high grade carbonaceous material by treating from 5–40% by weight of low ash coal or similar carbon-containing raw materials with 20–80% by weight of high-boiling aromatic solvents, derived from coal, and 15–50% by weight of high-boiling aromatic solvents, derived from mineral oil, at temperatures of 300°–420° C. and for a reaction period of 1–4 hours, at a reaction pressure of up to 50 bar.

2. The process of claim 1 wherein the solvents are freed of low-boiling components.

3. The process according to claim 1, wherein the product obtained is homogeneously mixed with 0–60% by weight of hard pitch, derived from mineral oil or derived from coal.

4. A binder composition produced by the method of claims 1, 2 or 3.

5. An electrode impregnated with a binder produced by the method of claims 1, 2 or 3.

6. A method of making a graphite electrode suitable for use in the electro-thermal refinement of metal ores comprising impregnating a carbon lattice with the binder composition produced by the method of claims 1, 2 or 3.

* * * * *